US006249204B1

(12) United States Patent
Larranaga et al.

(10) Patent No.: US 6,249,204 B1
(45) Date of Patent: Jun. 19, 2001

(54) APPARATUS AND METHOD FOR CONTINUOUS MAGNETIC CORE WINDING OF ELECTRICAL TRANSFORMERS AND INDUCTORS

(75) Inventors: Javier Larranaga, Bristol; Joe Criniti, New Britain; Farshid Attarian, Collinsville, all of CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/496,998

(22) Filed: Feb. 3, 2000

(51) Int. Cl.[7] ..... H01F 27/30
(52) U.S. Cl. ..... 336/198; 336/208
(58) Field of Search ..... 336/213, 198, 336/208; 29/602.1, 605, 606, 607, 608, 609

(56) References Cited

U.S. PATENT DOCUMENTS 714,891 * 12/1902 Gill ..... 336/213
4,060,783 * 11/1977 Harnden, Jr. ..... 335/296
4,592,133 6/1986 Grimes et al. .
5,635,891 * 6/1997 Miyoshi et al. ..... 336/198
5,860,207 1/1999 Knight et al. .

FOREIGN PATENT DOCUMENTS

291011 * 9/1953 (CH) ..... 336/213
1424518 * 12/1965 (FR) ..... 336/198
526611 * 9/1940 (GB) ..... 336/213

* cited by examiner

*Primary Examiner*—Aah Mai
(74) *Attorney, Agent, or Firm*—Cantor Colburn LLP; Carl B. Horton

(57) ABSTRACT

An apparatus for winding the magnetic core of an electronic transformer about a pre-formed wire coil, the apparatus comprising a first member, a second member, and a locking device for aligning and fastening said first member to said second member. The first member and the second member each further comprising a winding member, a first flange disposed at a first end of said winding member, and a second flange disposed at a second end of the winding member. A method of continuously winding a magnetic material onto a bobbin assembly to form a wound core of an electrical transformer is provided and comprises forming a bobbin assembly about a pre-formed wire coil, fixing a leading edge of the magnet material to the bobbin assembly, and rotating said bobbin assembly about the pre-formed wire coil to wind the magnetic material onto the bobbin assembly.

19 Claims, 7 Drawing Sheets

APPARATUS AND METHOD FOR CONTINUOUS MAGNETIC CORE WINDING OF ELECTRICAL TRANSFORMERS AND INDUCTORS

BACKGROUND OF THE INVENTION

The present invention relates to the field of electrical transformers and inductors and particularly to a method and an apparatus for constructing continuously wound magnetic cores of transformers and inductors.

Transformers and inductors and the construction thereof is common in the art. FIG. 1 depicts an exemplary electrical transformer known in the art, shown generally at 10. The transformer 10 comprises a double coil transformer having a first coil bobbin 12 and a second coil bobbin 14. Each of the coil bobbins 12 and 14 typically has a turn wire (not shown) wrapped about the bobbin. The turn wire of the first coil bobbin is connected to the turn wire of the second coil bobbin by an electrical wire 16. The electrical wire 16 terminates in a prong 18 which provides a means for connecting the transformer 10 to another device. The first and second coil bobbins 12 and 14 include openings 20 and 22, respectively.

The electrical transformer 10 further comprises a wound core of magnetic material 24. The magnetic material 24 is wound about both the first coil bobbin 12 and the second coil bobbin 14 through the openings 20 and 22, respectfully, to form a magnetic transformer core 26. The magnetic material 24 is typically a magnetic strip wound to a predetermined thickness and cut to form a trailing edge 28. The trailing edge 28 is secured to the underlying magnetic material 24 by welding or other common adhesive process.

There are several common practices known in the art for assembling the magnetic material 24 within the transformer 10 to form the magnetic transformer core 26. In one method, the transformer core 26 is formed out of a stack of laminations which are constructed utilizing commonly known techniques such as interleave, butt-stack, etc. The second commonly implemented method for constructing the magnetic core 26 of an electrical transformer 10 involves assembling two pre-formed cut magnetic core halves about the wire coil. Although commonly implemented, these methods of manufacturing the magnetic core elements of electrical transformers are very time consuming and costly to the manufacturer.

Another known method for assembling magnetic transformer cores utilizes a core winding mechanism which winds a magnetic material in and through openings formed in a wire coil bobbin such that the leading edge of the magnetic material is continuously threaded through the opening(s) formed in the bobbin(s) to form a wound transformer core. In effect, this method pushes the magnetic material through the opening of a wire coil bobbin to form a magnetic core there about. The resulting magnetic core is fashioned into a predetermined shape such as a rectangle, etc.

This winding method, however, encounters difficulties when utilizing certain magnetic materials. Thin magnetic materials tend to buckle and jam the winding mechanism when forced in and about the coil bobbins thus inhibiting the winding process. Thick or hard magnetic materials form bulkier magnetic transformer cores. Higher stresses are placed upon the thick material thus resulting in the degradation of the magnetic properties of the material. Further, a winding mechanism as described above is insufficient in attaining a prescribed tension of the magnetic core material, especially when thick or hard magnetic material is used.

U.S. Pat. No. 4,592,133 to Grimes et al ('133), incorporated fully herein by reference, teaches a method of constructing an electrical transformer which entails winding an electrical wire about a pre-formed laminated magnetic core. Similarly, U.S. Pat. No. 5,860,207 ('207) to Knight et al, incorporated fully herein by reference, teaches a method of constructing an electrical transformer by preforming a laminated magnetic transformer core and winding a conducting coil about said core by use of a winding bobbin. However, neither the '133 nor the '207 patent teaches a winding technique for the construction of the transformer core, thus both referenced patents require implementation of costly and time consuming traditional core manufacturing methods as are discussed herein above.

BRIEF SUMMARY OF THE INVENTION

The present invention is directed to a continuous core winding process and a winding apparatus used to produce electrical transformers. In its assembled state the electrical transformer may comprise at least one pre-formed wire coil with at least one magnetic core wound about said wire coil, in accordance with the present invention.

In an exemplary embodiment, the apparatus includes a first member and a second member. The first member is identical in description to the second member each comprising a winding member, a first flange, a second flange and a locking assembly. The winding member is substantially semi-cylindrical in shape with a convex outer surface and a concave inner surface. The first flange and the second flange are semi-circular in shape and include meshing protuberances or gear teeth on their circumferential edge. The first flange is mounted at one end of the winding member perpendicular to said winding member. The second flange is mounted perpendicularly at an end of the winding member opposite the first flange. The locking assembly includes a locking post and lock pin for securing the first member to the second member.

In an exemplary embodiment, the method of the present invention includes securing the first member to the second member about a pre-formed wire coil to form a bobbin assembly, fixing a magnetic material to the bobbin assembly, engaging the bobbin assembly with a drive mechanism, operating the drive mechanism to rotate the bobbin and thus wind the magnetic material about the bobbin assembly. The drive mechanism of the present invention may utilize a servo type motor to implement a prescribed number of revolutions to the bobbin assembly and to apply a specified tension to the wound magnetic element.

The above discussed and other features and advantages of the present invention will be appreciated and understood by those skilled in the art from the following detailed descriptions and drawings.

BRIEF DESCRIPTION OF THE DRAWINGS

Referring now to the drawings wherein like elements are numbered alike in the several Figures.

DETAILED DESCRIPTION OF THE INVENTION

Figure 1:
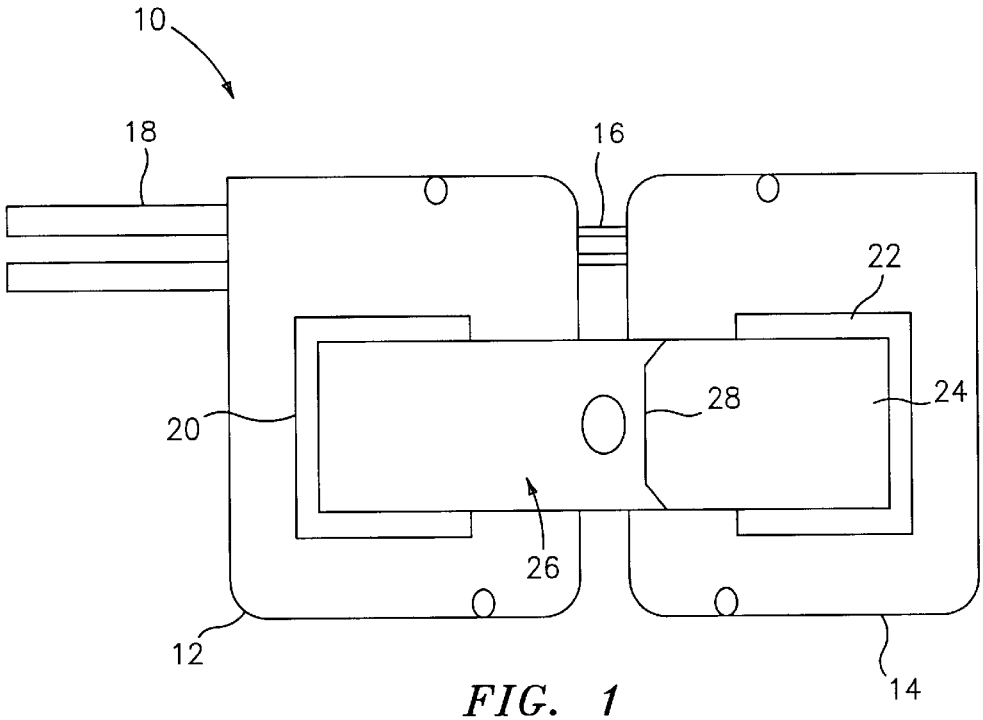
FIG. 1 (PRIOR ART)
FIG. 1 is a front elevation view of a conventional electrical transformer of the prior art.
Figure 2:
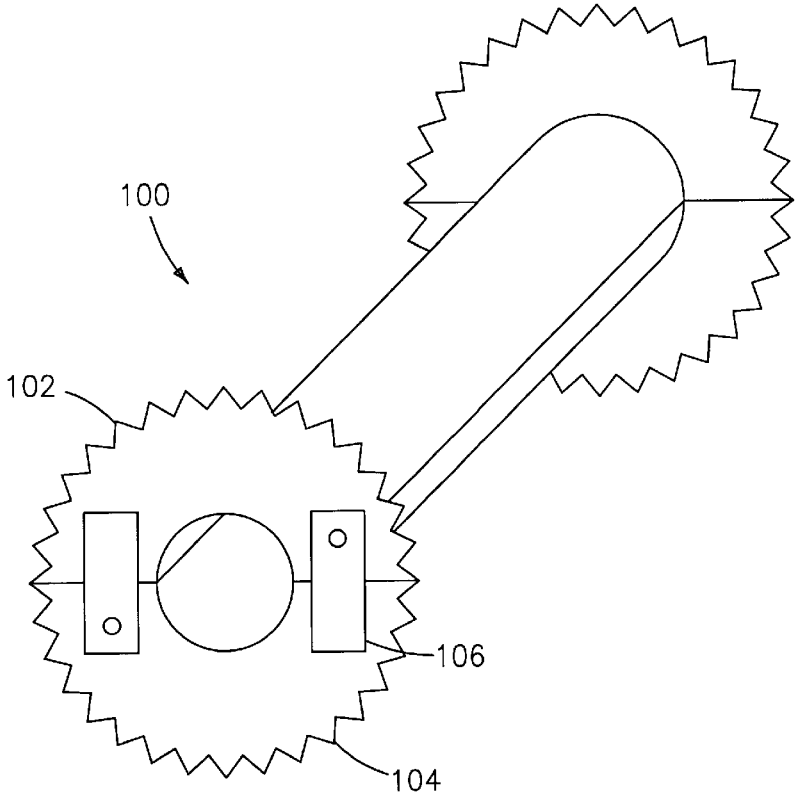
FIG. 2 is a perspective view of a split core bobbin in accordance with the present invention.
Figure 3:
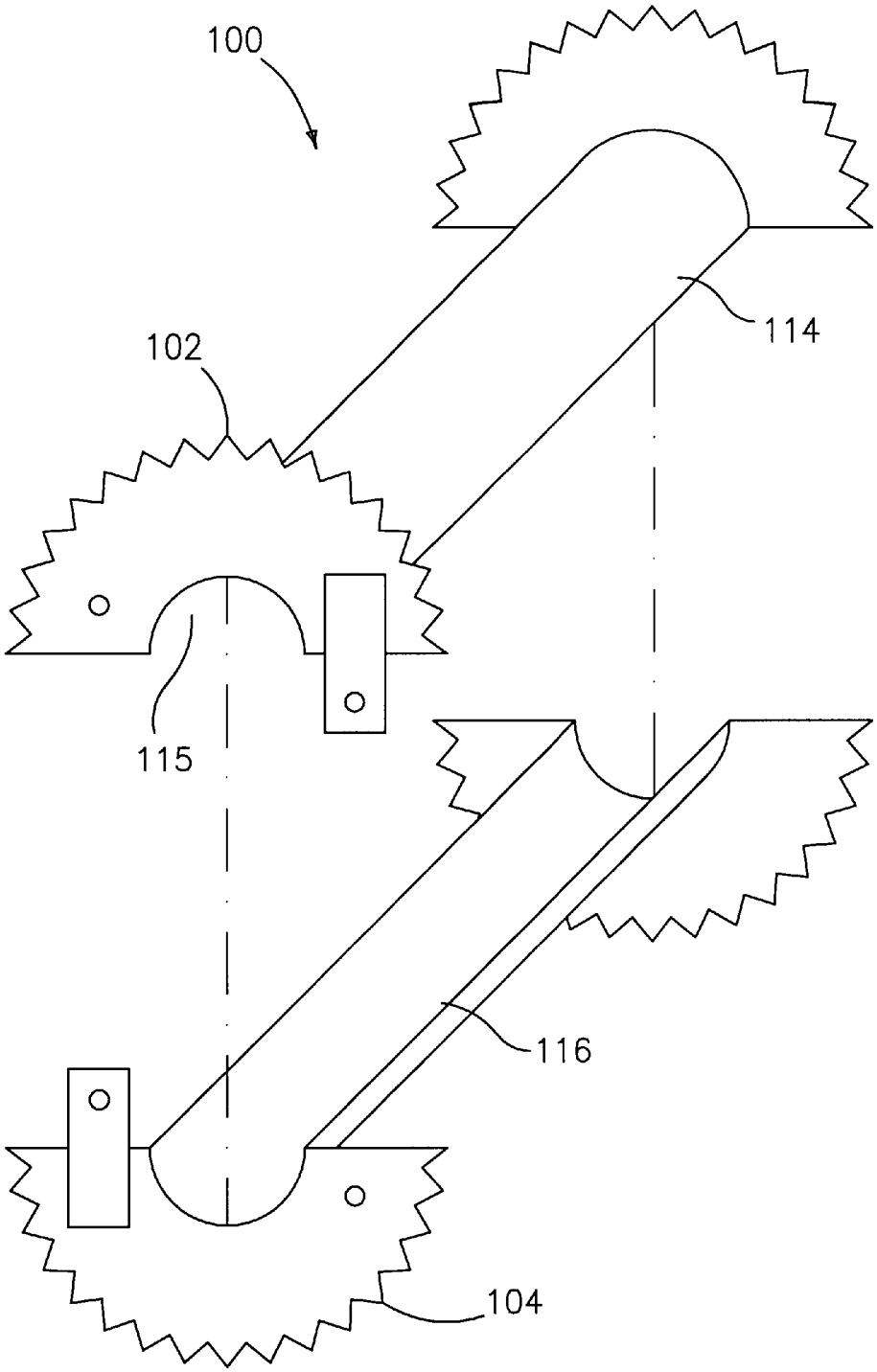
FIG. 3 is an exploded perspective view of the split core bobbin of FIG. 2.

FIG. 2 shows a perspective view of a split core bobbin assembly 100 in accordance with the present invention. The core bobbin assembly 100 includes, generally, a first core bobbin half 102 and a second core bobbin half 104. The first core bobbin half 102 is secured to the second core bobbin half 104 by a locking and alignment assembly 106, as is discussed further herein below. FIG. 3 shows an exploded perspective view of the split core bobbin assembly 100.

Figure 4:
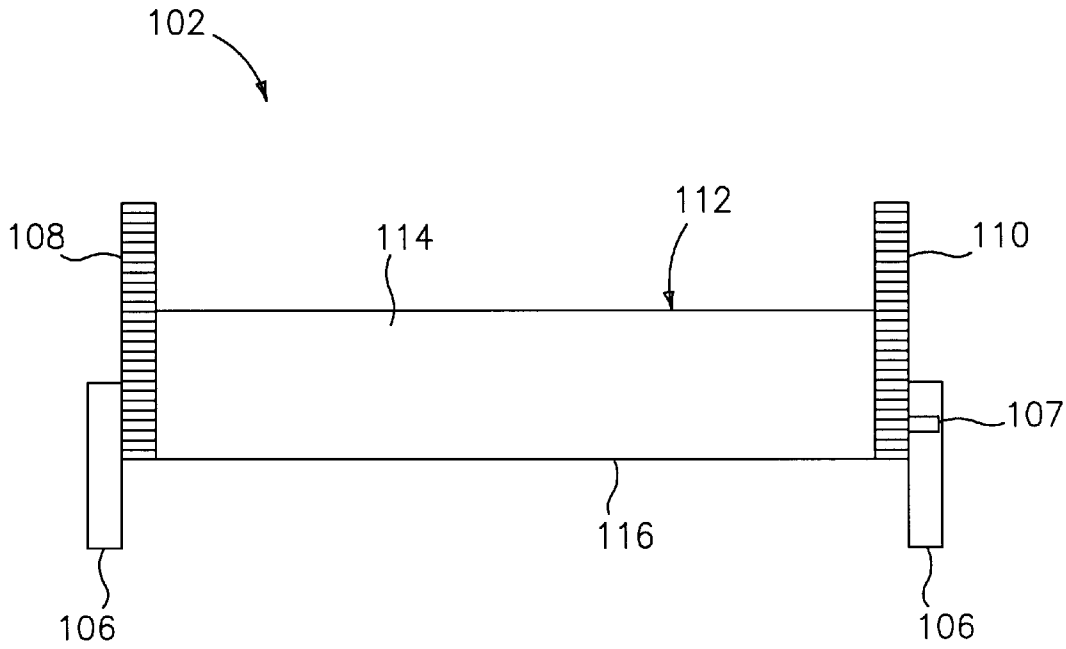
FIG. 4 is a side elevation view of one half of the split core bobbin of FIG. 2.

FIG. 4 shows a side elevation view of the first core bobbin half 102. The first core bobbin half 102 includes a first flange 108, a second flange 110, a winding member 112, and the locking and alignment assembly 106. The first flange 108 is fixed at one end of the winding member 112 perpendicular to the winding member 112. The second flange 110 is fixed to the end of the winding member 112 opposite the first flange 108. The second flange 110 is positioned relative to and parallel with the first flange 108.

Referring to FIGS. 3 and 4. The winding member 112 is generally semi-circular and includes a winding surface 114 and a mounting surface 116. The winding surface 114 is generally convex in shape and is of a predetermined radius to fit about a coil bobbin and to accommodate a prescribed magnetic material, as is discussed further herein below. The mounting surface 116 is generally concave and is approximately congruent to the winding surface 114 thus creating hollow 115, as shown in FIG. 3. The edges of the mounting surface 116 of the first split core bobbin half 102 contact the edges of the mounting surface of the second split core bobbin half 104 when the split bobbin assembly 100 is fully assembled as depicted in FIG. 2.

Referring again to FIG. 4, the first and second flanges 108 and 110 are mounted to the winding member 112 as discussed herein above such that the first flange 108 and the second flange 110 are flush with the mounting surface 116 at one end and extend beyond the winding surface 114 of the winding member 112 at the other end. The first flange 108 includes the locking and alignment assembly 106 which is disposed on the first flange 108 parallel to the longitudinal axis of the first flange 108 such that the locking and alignment assembly 106 extends perpendicularly from the winding member 112. The second flange 10 includes a second locking and alignment assembly 106 disposed parallel to the longitudinal axis of the second flange member 110 extending perpendicularly from the mounting surface 116. The locking and alignment assemblies 106 assist in positioning and securing the first core bobbin half 102 to the second core bobbin half 104 when mounted about a wire coil in transformer/inductor assemblage, as is discussed more fully herein below.

Figure 5:
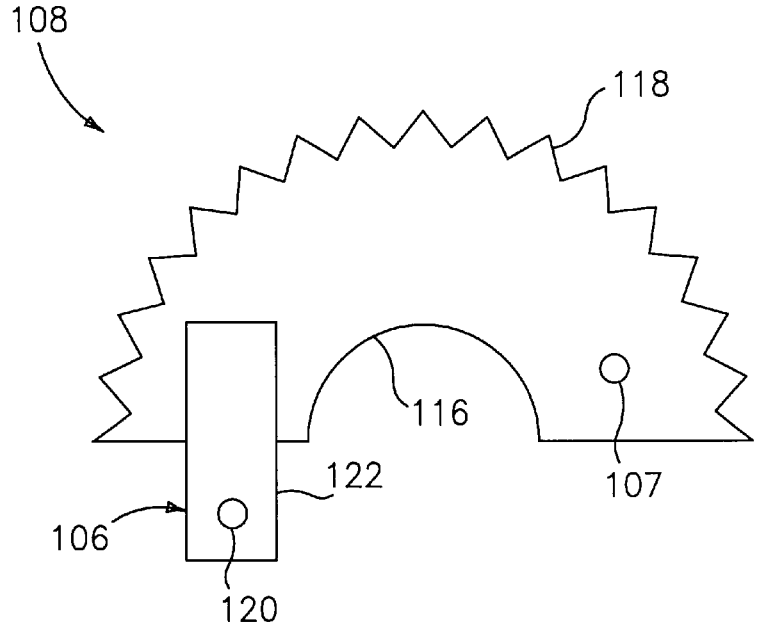
FIG. 5 is an end elevation view of one half of the split core bobbin of FIG. 3.

FIG. 5 shows a front elevation view of the first flange member 108 of the first bobbin half 102. The first flange member 108 is substantially semi-circular in shape and includes a serrated surface 118, a locking pin 107, the locking and alignment assembly 106, and the mounting surface 116. The serrated surface 118 comprises the circumferential surface of the first flange member 108. The serrated surface 118 may contain gear teeth or similar meshing protuberances for engaging a pinion wheel drive motor assembly during the continuous transformer core winding technique in accordance with the present invention, as is discussed further herein below. The locking and alignment assembly 106 is disposed on the first flange member 108 such that the assembly 106 extends beyond the first flange member 108 in a direction away from the pinion surface 118. The locking and alignment assembly 106 is formed of a locking post 122 and a lock pin mating port 120. The locking post 122 preferably comprises a rectangular member extending from and integral to the flange 108. The lock pin mating port 120 is disposed on the portion of the locking and alignment assembly 106 which extends beyond the mounting surface 116. The locking pin 107 may be a protuberance which is disposed on the first flange 108 a predetermined distance from both the locking and alignment assembly 106 and the mounting surface 116. The locking and alignment assembly 106 and the lock pin 107 are each positioned on the first flange 108 so as to properly mate with a second lock pin and a second locking and alignment assembly, respectively, of a second split bobbin half when constructing the core bobbin assembly 100 in accordance with the present invention, as is discussed further herein below. Referring again to FIG. 4, the construction of the second flange 110 is substantially identical to that of the first flange 108 herein discussed above. The positioning of the locking and alignment assembly 106 and the lock pin 107 on the second flange 110 may be identical to the positioning on the first flange 108 or may be reversed relative to the positioning of the assembly 106 and the pin 107 on the first flange 108.

The second core bobbin half 104 is identical to the first core bobbin half 102 discussed herein above. Thus, to avoid the confusion of repetition and to preserve brevity, a detailed description of the second core bobbin half 104 has been omitted, with reference, instead, to the above description of the first core bobbin half 102. It is understood that the first core bobbin half 102 and the second core bobbin half 104 are symmetrical in nature so that the two may mate with one another.

Figure 6:
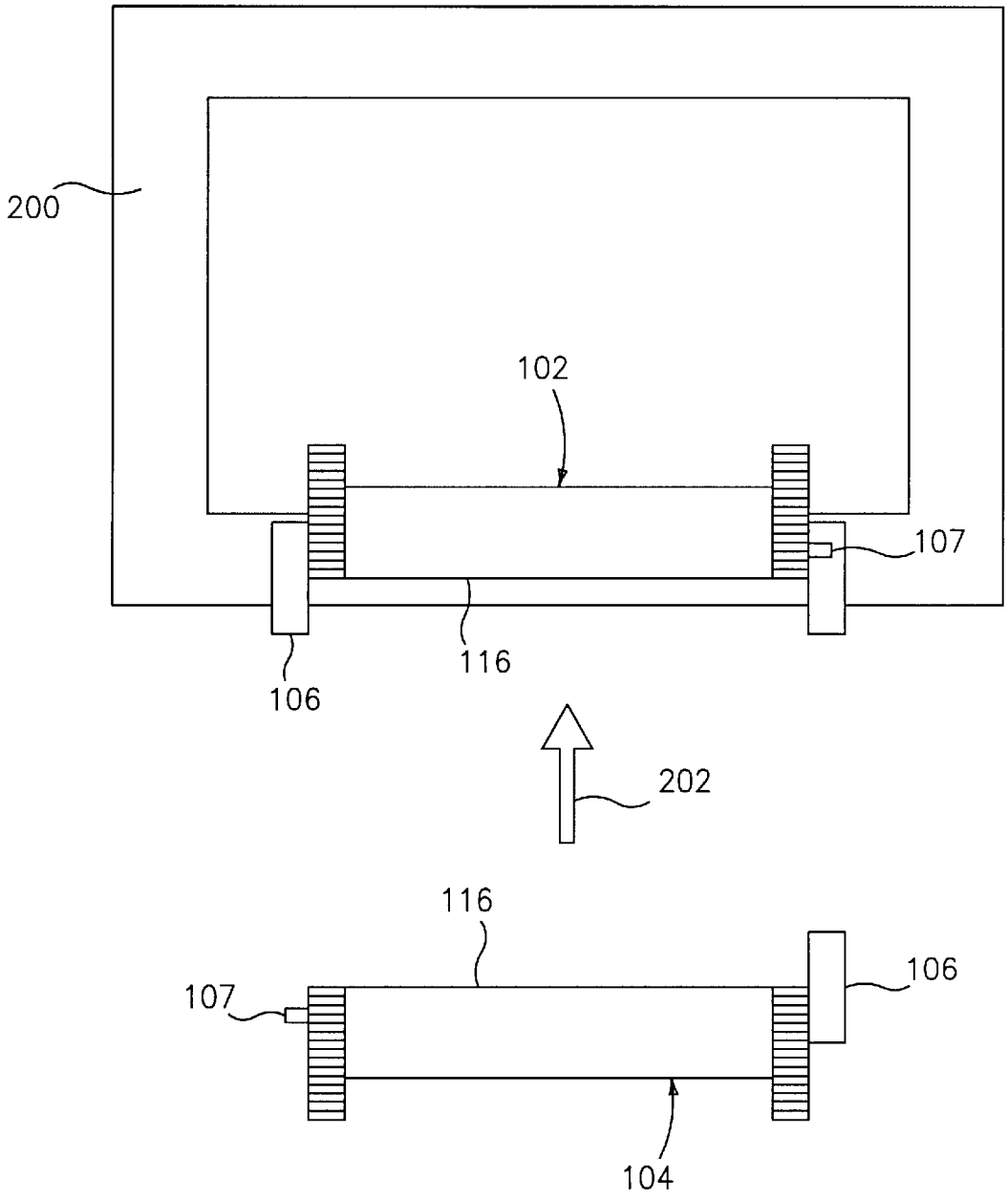
FIG. 6 depicts a first step of a method of constructing a continuous wound magnetic core for electrical transformers and inductors in accordance with the present invention.
Figure 7:
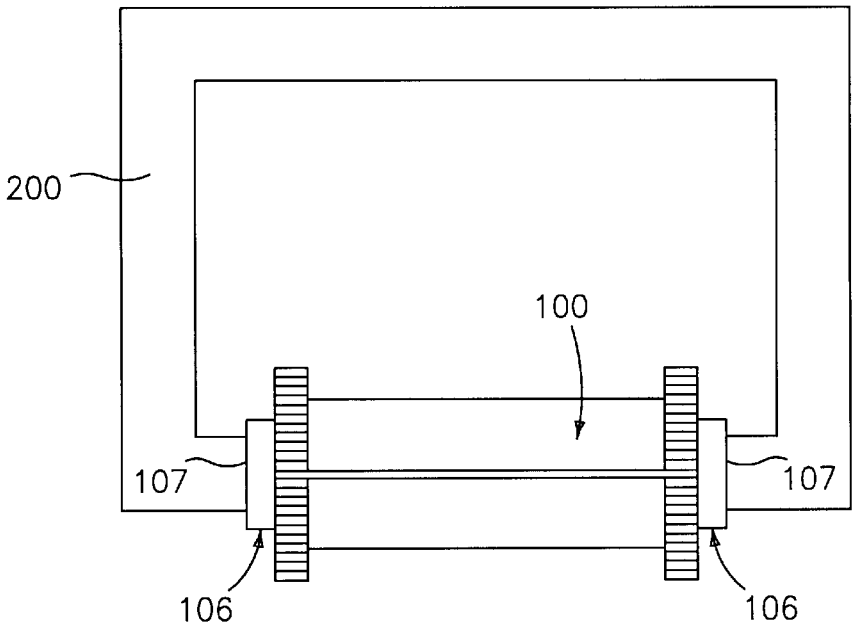
FIG. 7 depicts a second step in the method of constructing a continuous wound magnetic core for electrical transformers and inductors in accordance with the present invention.
Figure 8:
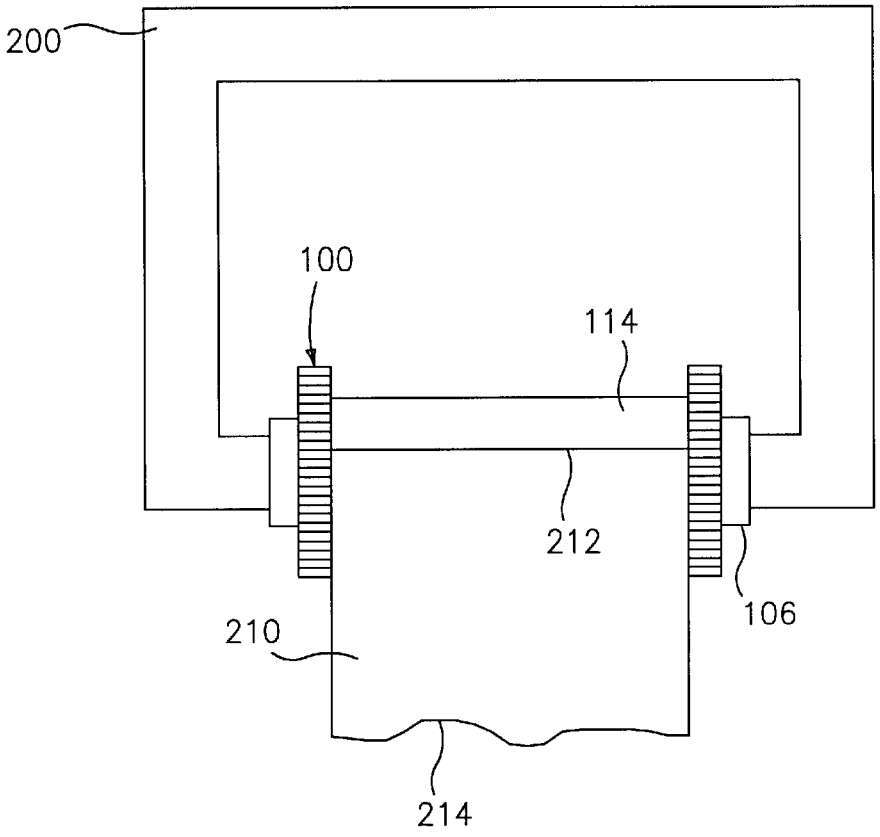
FIG. 8 shows a third step in a method of constructing a continuous wound magnetic core for electrical transformers and inductors in accordance with the present invention.

Referring now to FIGS. 6–8, the method for continuous magnetic core winding of electrical transformers and inductors, in accordance with the present invention, is depicted. FIG. 6 shows an exemplary first step of the method in accordance with the present invention. FIG. 6 depicts a side elevation view of a pre-formed wire coil 200, the first core bobbin half 102, and the second core bobbin half 104. The wire coil 200 may be any of a plurality of wire coils known in the art, constructed in any of a plurality of methods common to the art.

An exemplary method of continuous magnetic core winding of electrical transformers in accordance with the present invention may begin by constructing the core bobbin assembly 100 about the wire coil 200. The first core bobbin half 102 is positioned about a portion of the wire coil 200. Next, the second core bobbin half 104 is brought in the direction of arrow 202 into position with the first core bobbin half 102.

The second core bobbin half 104 is positioned such that the mounting surfaces 116 of the first core bobbin half 102 and the second core bobbin half 104 are brought into contact about the wire coil 200. In FIG. 7, the second core bobbin half 104 is secured to the first core bobbin half 102 by mating the locking and alignment assemblies 106 with the respective locking pins 107. The lock pins 107 are received in the lock pin mating ports 120 of the respective locking posts 122 (FIG. 5). Securing the core bobbin halves 102 and 104 about the wire coil 200 in this manner insures proper mating and alignment of the first and second core bobbin halves 102 and 104 thus properly forming the core bobbin assembly 100 as depicted in FIG. 7. Properly formed in the above discussed manner, the bobbin assembly 100 is free to rotate about a portion of the wire coil 200.

FIG. 8 depicts the next step of an exemplary method of continuous magnetic core winding of electrical transformers in accordance with the present invention. A magnetic material 210 is fixed to the winding surface 114 of the bobbin assembly 100. The magnetic material 210 may be secured to the bobbin 100 by implementing any of a plurality of common adhesive techniques including, but not limited to, using adhesive tape and other techniques, such as welding the magnetic material 210 to the bobbin assembly 100, and fashioning a leading edge 212 of the magnetic material 210 such that it can be retained to the split bobbin assembly 100. For example, the leading edge 212 may be received into a slot (not shown) formed in the bobbin assembly 100 such that the leading edge 212 is captured and retained therein.

Figure 9:
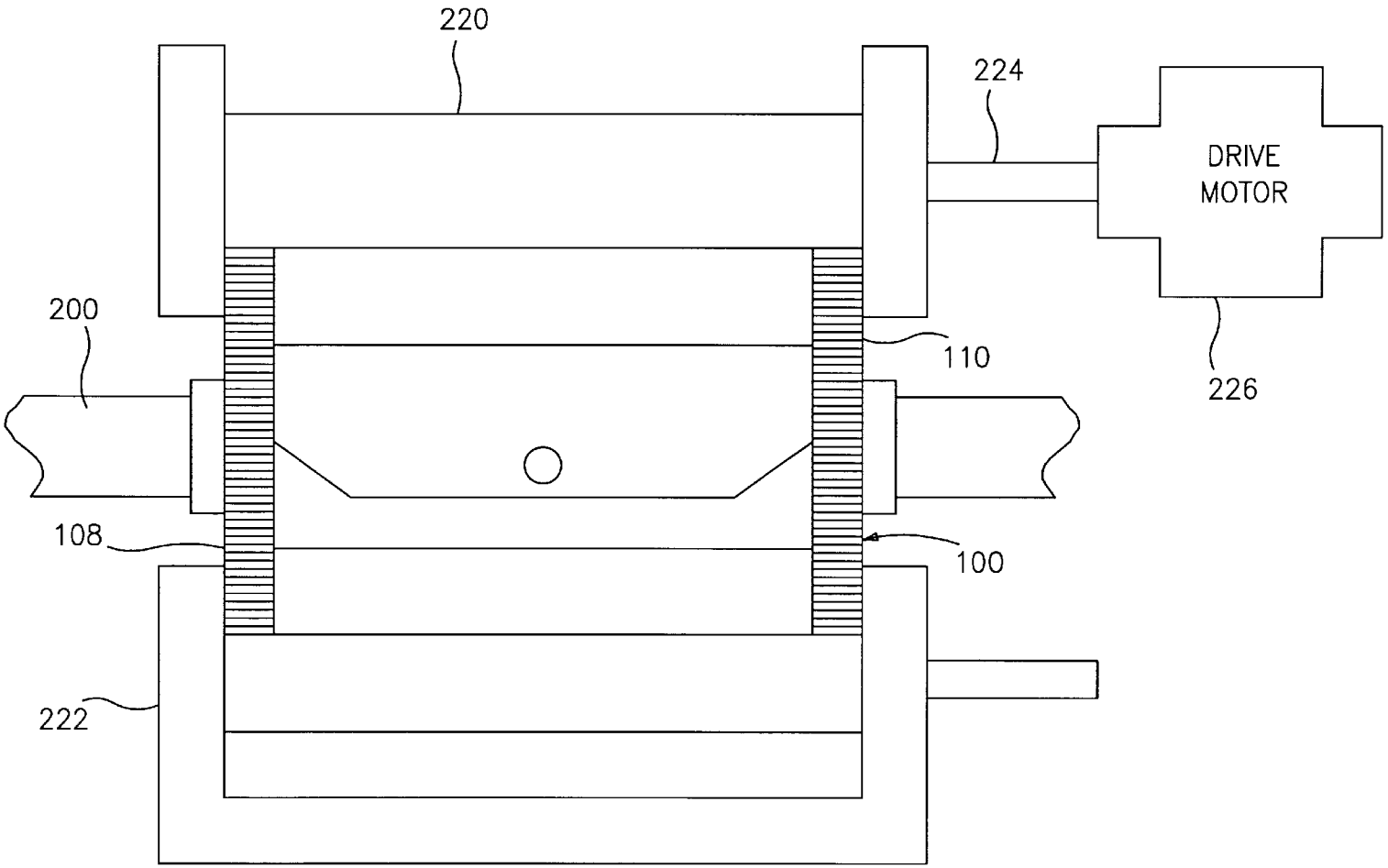
FIG. 9 shows another step in a method of constructing a continuous wound magnetic core for electrical transformers and inductors in accordance with the present invention.

Referring to FIGS. 2, 8, and 9. FIG. 9 shows the final step of an exemplary method of continuous magnetic core winding of electrical transformers in accordance with the present invention. A drive gear 220 is brought into contact with the first flange 108 and the second flange 110. The drive gear 220 is fitted with gear teeth or other protuberances which engage the first and second flanges 108 and 110 in meshing contact. An idle gear 222 is brought into contact with the first flange 108 and the second flange 110 of the first split bobbin half 102 or said flanges of the second split bobbin half 104 of the bobbin assembly 100. The drive gear 220 is connected to a rod 224 that is connected to a drive motor 226. The drive motor 226 applies a torque to the rod 224 thus turning the drive gear 220 and hence turning the bobbin assembly 100 resulting in the winding of the magnetic material 210 about the core bobbin assembly 100. The idle gear 222 engages the first the second flanges of the bobbin 100 with gear teeth or similar protuberances. The idle gear 222 balances the engaging force of the drive gear 220 as the drive motor 226 winds the magnetic material 210 about the bobbin assembly 100. The drive motor 226 may be powered by a 'servo' type motor so as to accurately control the amount of winding turns required for a chosen magnetic material and for a prescribed radius of the winding member 112. The magnetic material 210 can be pre-cut to desired dimensions or it may be of continuous length and then severed when a prescribed number of turns of the bobbin assembly 100 are made. A prescribed tension is applied to the magnetic material 210 during the winding process specific to the prescribed magnetic material 210 and/or the particular application of the transformer or inductor. A trailing edge 214 of the magnetic material 210 is secured to the underlying magnetic material 210 by any of a plurality of common adhesive processes.

Figure 10:
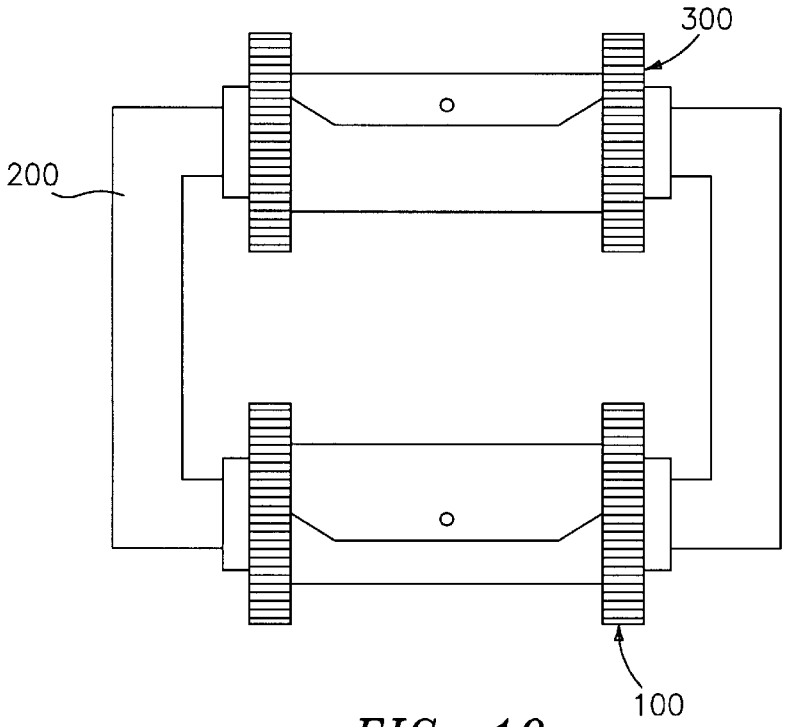
FIG. 10 is an alternative application of the method in accordance with the present invention.

A specific transformer or inductor application may require a plurality of magnetic cores be constructed about the wire coil 200. FIG. 10 shows a side elevation view of an arrangement of the wound bobbin assembly 100 and a second wound bobbin assembly 300 assembled about the wire coil 200 in accordance with the present invention. The bobbin assembly 300 is installed about the wire coil using the method disclosed herein above.

Figure 11:
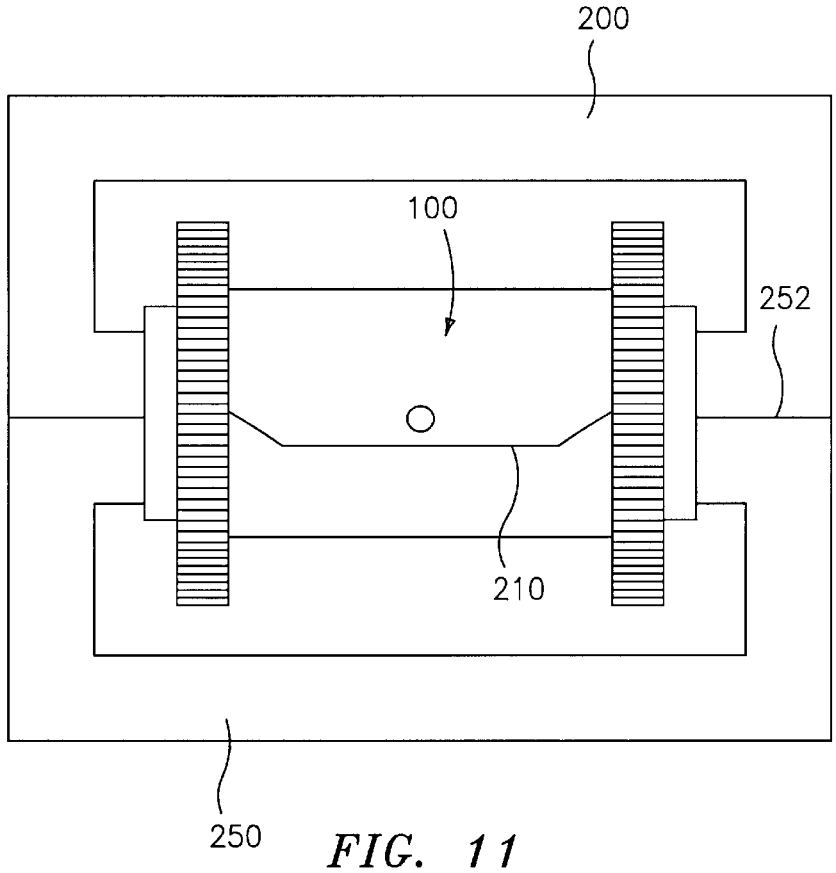
FIG. 11 is an alternative application of the method in accordance with the present invention.

FIG. 11 depicts a side elevation view of an alternative embodiment of the magnetic core and wire coil arrangement assembled in accordance with the present invention. The wire coil 200 is coupled with a second wire coil 250 at an edge 252. The core bobbin assembly 100 is installed about the interface of the wire coil 200 and the second wire coil 250 at the edge 252. The core bobbin assembly 100 is installed about the wire coils as discussed herein above by positioning the first bobbin half 102 and then the second bobbin half 104 about the coils and securing them via the locking and alignment assemblies 106. The magnetic material 210 is wound about the bobbin assembly 100 using the method as described herein above.

Another alternative embodiment of the present invention utilizes a standard, non-split core winding bobbin. The magnetic material may be wound about the standard bobbin by using a modified coil winding machine in which the feed mechanism allows magnetic material to be fed instead of the wire feeding instituted by the prior art. The standard bobbin is tooled into a standard winding anvil and the magnetic strip is wound onto said bobbin from the modified feed mechanism. The wound standard bobbin may be used as a receiving member for a split bobbin wire coil assembly in the construction of a transformer or inductor.

The bobbin assembly 100 of the present invention may be formed of any suitable material and in one exemplary embodiment, the bobbin assembly 100 is formed of a suitable plastic material.

While preferred embodiments have been shown and described, various modification and substitutions may be made thereto without departing from the spirit and scope of the invention. Accordingly, it is understood that the present invention has been described by way of illustrations and not limitation.

What is claimed is:

1. An electrical transformer comprising:

a bobbin assembly including:

a first bobbin member;

a second bobbin member, each of the first and second bobbin members including first and second flange members defining first and second ends of the bobbin members and a smooth uninterrupted winding member extending between the first and second flange members, the first and second flange members each comprising a serrated semicircular outer periphery, a semicircular inner periphery, and two flat connecting peripheral sections connecting the semicircular outer periphery with the semicircular inner periphery;

each of the first and second flange members including a locking mechanism having a locking post and a locking pin for aligning and fastening the first bobbin member to the second bobbin member, wherein the two flat connecting peripheral sections of each of the first and second flange members of each of the first and second bobbin members abut flushly, and the serrated semicircular outer periphery of each of the first and second flange members of each of the first and second bobbin members form a serrated circular outer periphery on opposite ends of the bobbin assembly; and a coil disposed about the first and second bobbin members, wherein a portion of the coil is captured between the first and second bobbin members.

2. The electrical transformer of claim 1, wherein the winding member comprises an arcuate member extending between the first and second flanges and having a first surface and an opposing second surface.

3. The electrical transformer of claim 2, wherein the first surface comprises a convex surface and the second surface defines an arcuate channel.

4. The electrical transformer of claim 1, wherein the winding member comprises a semi-circular member having an arcuate outer surface and an inner surface defining an arcuate channel.

5. The electrical transformer of claim 1, further including a second coil disposed about the first and second bobbin members so that a portion of the second coil is also disposed between the first and second bobbin members.

6. The electrical transformer of claim 5, wherein the second coil comprises a wire coil disposed about a second coil bobbin which is disposed about the first and second bobbin so that a portion of the coil bobbin is captured there between.

7. The electrical transformer of claim 1, wherein each of the first and second flanges includes an inner surface facing the winding member and an outer surface which includes the locking mechanism for interlocking the first flange of the first bobbin member to the first flange of the second bobbin member and the second flange of the first bobbin member to the second flange of the second bobbin member.

8. The electrical transformer of claim 1, wherein the first and second flanges are perpendicular to the winding member and a lower portion thereof is integral to the winding member.

9. The electrical transformer of claim 1, wherein an opening is formed between the winding members of the first and second bobbin members, the opening receiving the portion of the coil which is captured between the first and second bobbin members.

10. The electrical transformer of claim 1, wherein the coil comprises a wire coil disposed about a coil bobbin which is disposed about the first and second bobbin members so that a portion of the coil bobbin is captured there between.

11. The electrical transformer of claim 1, wherein the locking mechanism comprises a first locking post extending away from the first flange of the first bobbin member and a second locking post extending away from the second flange of the second bobbin member, each of the first and second locking posts including an opening formed therein, the second flange of the first bobbin member and the first flange of the second bobbin member each including a pin formed thereon, wherein the pin of the second flange of the first bobbin member is received within the opening formed in the second locking post and the pin of the first flange of the second bobbin member being received within the opening formed in the first locking post to securely mate the first and second bobbin members to one another.

12. The electrical transformer of claim 11, wherein the first and second locking posts each comprise an elongated member parallel to the respective flange and extending away from the flange so that the opening is formed in a portion of the locking post which extends outside a peripheral edge of the flange.

13. The electrical transformer of claim 1, wherein the fastening of the winding members of the first and second bobbin members forms a generally circular surface for receiving at least one core.

14. The electrical transformer of claim 1, further including third and fourth bobbin members, each of the third and fourth bobbin members including a winding member extending between first and second flange members, each of the third and fourth bobbin members including a locking mechanism for aligning and fastening the third bobbin member to the fourth bobbin member; the coil being disposed about the third and fourth bobbin members, wherein a portion of the coil is captured therebetween.

15. A method of continuously winding a magnetic material onto a bobbin assembly to form a wound core of an electrical transformer, the method comprising:

providing a first bobbin member and a second bobbin member with each a first flange and a second flange on opposite ends of their respective bobbin members, the first and second flanges each having a serrated semicircular outer periphery, a semicircular inner periphery, and two flat connecting peripheral sections connecting the semicircular outer periphery with the semicircular inner periphery;

providing each first flange and second flange with a locking mechanism for aligning and fastening the first bobbin member to the second bobbin member;

providing each of the first and second bobbin members with a smooth uninterrupted winding member extending between the first and second flanges;

fastening the first bobbin member to the second bobbin member by abutting the two flat connecting peripheral sections of the first flange of the first bobbin member to the two flat connecting peripheral sections of the first flange of the second bobbin member, abutting the two flat connecting peripheral sections of the second flange of the first bobbin member to the two flat connecting peripheral sections of the second flange of the second bobbin member, and locking the first bobbing member to the second bobbin member by mating a first locking post extending from the first bobbin member with a first locking pin formed on the second bobbin member and mating a second locking post extending from the second bobbin member with a second locking pin formed on the first bobbin member to form a bobbin assembly so that a portion of the coil is captured between the first and second bobbin members;

fixing a leading edge of said magnetic material to the bobbin assembly; and employing said flanges for rotating said bobbin assembly about said preformed coil to wind the magnetic material about the winding members of the bobbin assembly.

16. The method of claim 15, wherein fastening the first bobbin member to the second bobbin member includes joining the serrated semicircular outer periphery of the first flange of the first bobbin member to the serrated semicircular outer periphery of the first flange of the second bobbin member to form a serrated circular outer periphery of joined first flanges, joining the serrated semicircular outer periphery of the second flange of the first bobbin member to the serrated semicircular outer periphery of the second flange of the second bobbin member to form a serrated circular outer periphery of joined second flanges, wherein the serrated circular outer peripheries define a plurality of teeth which permit intermeshing of the plurality of teeth with a drive unit for rotating the bobbin assembly.

17. The method of claim 15, wherein fixing the leading edge of the magnetic material to the bobbin assembly comprises adhering the magnetic material to the bobbin assembly or inserting the magnetic material in the bobbin assembly.

18. The method of claim 15, wherein rotating the bobbin assembly about the pre-formed wire coil comprises bringing the bobbin assembly into contact with a drive mechanism and operating the drive mechanism.

19. The method of claim 18, wherein said drive mechanism comprises a drive gear, an idle gear, and a drive motor, the drive gear and the idle gear being in meshing engagement with the bobbin assembly.

* * * * *